US008204401B2

(12) United States Patent
Tsuchiya

(10) Patent No.: US 8,204,401 B2
(45) Date of Patent: Jun. 19, 2012

(54) IMAGE FORMING APPARATUS WITH EXTERIOR ACCESS

(75) Inventor: Hiroaki Tsuchiya, Nishinomiya (JP)

(73) Assignee: Kyocera Mita Corporation (JP)

( * ) Notice: Subject to any disclaimer, the term of this patent is extended or adjusted under 35 U.S.C. 154(b) by 547 days.

(21) Appl. No.: 12/350,454

(22) Filed: Jan. 8, 2009

(65) Prior Publication Data

US 2009/0175648 A1 Jul. 9, 2009

(30) Foreign Application Priority Data

Jan. 8, 2008 (JP) ..... 2008-001412

(51) Int. Cl.
*G03G 15/00* (2006.01)

(52) U.S. Cl. ..... 399/107

(58) Field of Classification Search ..... 399/107, 399/124, 110

See application file for complete search history.

(56) References Cited

U.S. PATENT DOCUMENTS

| | | | | |
|---|---|---|---|---|
| 6,968,143 | B2 * | 11/2005 | Blair et al. | 399/124 |
| 6,978,102 | B2 * | 12/2005 | Okamura et al. | 399/110 |
| 7,266,325 | B2 * | 9/2007 | Hirose et al. | 399/107 |
| 7,349,648 | B2 * | 3/2008 | Rennick et al. | 399/110 |
| 7,386,252 | B2 * | 6/2008 | Portig et al. | 399/110 |

FOREIGN PATENT DOCUMENTS

| | | | |
|---|---|---|---|
| JP | 2001152724 A | * | 6/2001 |
| JP | 2006-126406 | | 5/2006 |
| JP | 2007-228569 | | 9/2007 |

* cited by examiner

*Primary Examiner* — Susan Lee
(74) *Attorney, Agent, or Firm* — Ostrolenk Faber LLP

(57) ABSTRACT

An image forming apparatus, including: an exterior portion having a first panel and a second panel that are opened/closed when an internal mechanism for image formation is taken outside; and an opening/closing interlocking device that makes the second panel open/close in connection with an opening/closing operation of the first panel.

12 Claims, 4 Drawing Sheets

IMAGE FORMING APPARATUS WITH EXTERIOR ACCESS

Priority is claimed on Japanese Patent Application No. 2008-001412, filed on Jan. 8, 2008, the contents of which are incorporated herein by reference.

BACKGROUND OF THE INVENTION

1. Field of the Invention

The present invention relates to an image forming apparatus including an exterior portion that opens and closes when an internal mechanism for image formation is taken outside.

2. Description of the Related Art

In image forming apparatuses such as printers and copy machines, an internal mechanism can be taken out from the apparatus to clear a paper jam inside, or for maintenance or replacement of the internal mechanism.

To be more specific, such an image forming apparatus includes an exterior portion that is openably provided. Opening the exterior portion exposes the internal mechanism.

With the recent downsizing or the like of the image forming apparatuses, it is becoming difficult to secure a space which allows the exterior portion to be opened and closed.

For example, in an image forming apparatus where a scanner is provided above a paper discharge tray portion, it is not possible to secure a space for opening/closing an exterior portion because the scanner is an obstacle to that.

Therefore, Japanese Unexamined Patent Publication, First Publication No. 2007-228569 and Japanese Unexamined Patent Publication, First Publication No. 2006-126406 propose a method of connecting a scanner portion to a main unit of an image forming apparatus via a hinge portion so as to be openable with respect to the main unit.

According to such a method, the scanner portion is opened in the upper direction, to thereby make it possible to secure a space for opening/closing the exterior portion.

However, the scanner portion is a heavy load. Therefore, the method of the above patent documents has a problem of placing a heavy burden on the user when the scanner portion is opened/closed. Furthermore, when the scanner portion is opened/closed, a strong force also acts on the hinge portion. This poses another problem of requiring additional measures such as enhancing strength of the hinge portion.

The present invention has been achieved in view of the aforementioned problems, and has an object to reduce the size of a space for opening/closing an exterior portion and also to facilitate opening/closing of the exterior portion.

SUMMARY OF THE INVENTION

In order to achieve the above-described object, the present invention employs the following. Namely, the present invention employs an image forming apparatus, including: an exterior portion having a first panel and a second panel that are opened/closed when an internal mechanism for image formation is taken outside; and an opening/closing interlocking device that makes the second panel open/close in connection with an opening/closing operation of the first panel.

It may be arranged such that the opening/closing interlocking device includes: a first rack which is connected to the first panel; a second rack which is connected to the second panel; a first pinion which is provided on a main unit of the image forming apparatus and meshed with the first rack; and a second pinion which is provided on the main unit of the image forming apparatus and meshed with the second rack.

It may be arranged such that a distance between a connection position of the first rack to the first panel and a pivot portion for opening/closing the first panel is different from a distance between a connection position of the second rack to the second panel and a pivot portion for opening/closing the second panel.

It may be arranged such that the first pinion and the second pinion are formed coaxially, and have a different number of teeth from each other.

It may be arranged such that the image forming apparatus further includes a safety switch that is pressed down by either one of the first rack and the second rack to allow a drive of the image forming apparatus in a state where the first panel and the second panel are closed.

It may be arranged such that the second panel is a panel opened to a paper discharge space formed between a paper discharge tray portion and a scanner portion of the image forming apparatus; and an opening/closing angle of the second panel is smaller than an opening/closing angle of the first panel.

It may be arranged such that the second panel is a part of the paper discharge tray portion.

It may be arranged such that the first panel covers a part of the second panel in a state where the first panel and the second panel are closed.

It may be arranged such that the first panel is provided on a front of the image forming apparatus.

According to the above image forming apparatus, an openable exterior portion has a plurality of panels. Therefore, it is possible to reduce the size of a space required when the openable exterior portion is opened. Furthermore, according to the above image forming apparatus, with an opening/closing operation of any one of the panels, the other panels are opened/closed by an opening/closing interlocking device. Therefore, the operator can open/close all the panels by opening/closing only one of the plurality of panels.

Therefore, according to the above image forming apparatus, it is possible to reduce the size of a space for opening/closing the exterior portion and also to facilitate opening/closing of the exterior portion.

DETAILED DESCRIPTION OF THE INVENTION

Hereunder is a description of an image forming apparatus according to one embodiment of the present invention. In the following drawings, scales of respective members are appropriately modified for easy recognition of the respective members. Furthermore, in the following description, a multifunction device provided with a plurality of functions such as that of a printer and a copy machine will be described as one example of an image forming apparatus according to the present invention.

Figure 1:
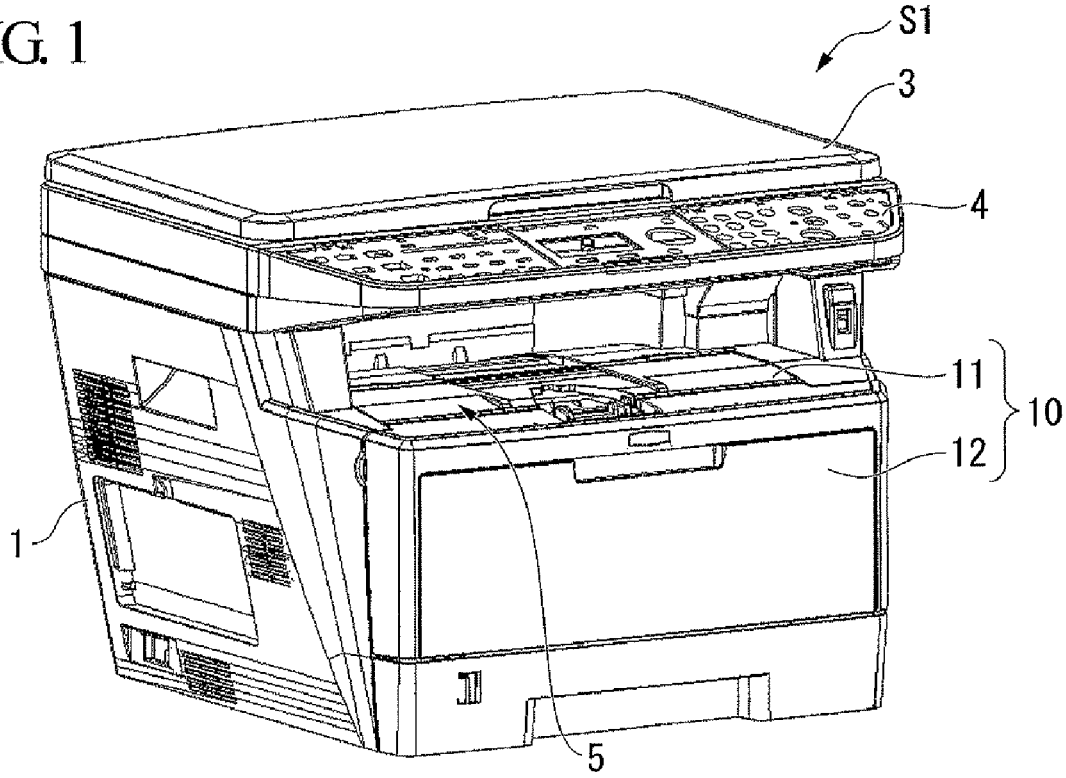
FIG. 1 is a perspective view showing a multifunction device according to one embodiment of the present invention with an upper cover portion and a front cover portion closed.
Figure 2:
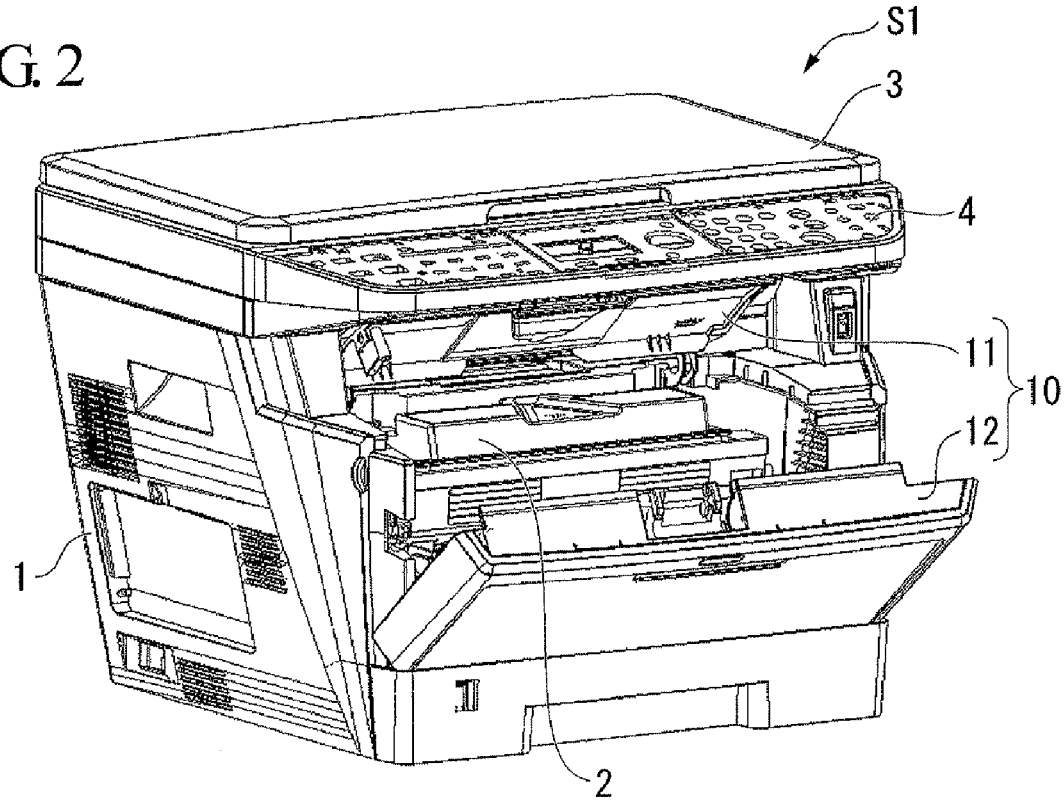
FIG. 2 is a perspective view showing the multifunction device according to the embodiment with the upper cover portion and the front cover portion opened.

FIG. 1 and FIG. 2 are perspective views of a multifunction device S1 of the present embodiment. FIG. 1 is a perspective view showing the multifunction device S1 a cover portion 10 (exterior portion) closed. FIG. 2 is a perspective view showing the multifunction device S1 with the cover portion 10 opened.

The multifunction device S1 uses an image creation unit 2 (internal mechanism for image formation) contained in an interior of a main unit 1 to perform printing on a recording sheet. The multifunction device S1 includes: a scanner portion 3; a display operation portion 4; and a paper discharge tray portion 5, in addition to the main unit 1 and the image creation unit 2.

The image creation unit 2 includes: a drum unit provided with a photosensitive drum on which is formed an electrostatic latent image based on image data; a development unit that supplies toner to the photosensitive drum to develop the electrostatic latent image; and a toner cartridge that contains toner to be supplied to the development unit. Furthermore, it is configured such that the image creation unit 2 is attachable/detachable to/from the main unit 1 for clearing a paper jam inside the multifunction device S1, or for maintenance or replacement of the internal mechanism of the multifunction device S1.

The scanner portion 3 reads image data of the original document. The scanner portion 3 is arranged on the upper side of the main unit 1.

As a man-machine interface for relating the user to the multifunction device S1, the display operation portion 4 is arranged integrally with the scanner portion 3. The display operation portion 4 includes a touch screen, operation keys, and the like.

The paper discharge tray portion 5 is arranged between the main unit 1 and the scanner portion 3. To the paper discharge tray portion 5, a recording sheet on which an image is printed by the image creation unit 2 or the like is discharged.

Furthermore, the multifunction device S1 of the present embodiment includes the cover portion 10 that is openable with respect to the main unit 1, in order to allow the image creation unit 2 to be taken outside.

In the multifunction device S1 of the present embodiment, the cover portion 10 has: a panel-shaped upper cover portion 11 (panel); and a similarly panel-shaped front cover portion T2 (panel). That is, the cover portion 10 of the multifunction device S1 according to the present embodiment has a plurality of cover portions (panels).

The upper cover portion 11 constitutes a part of the paper discharge tray portion 5. The upper cover portion 11 is pivotally supported so as to be openable in an up-down direction with respect to the main unit 1. That is, in the multifunction device S1 of the present embodiment, the scanner portion 3 is arranged above the upper cover portion 11, and is thereby an obstacle to the opening/closing operation of the upper cover portion 11.

The front cover portion 12 is arranged on the front of the multifunction device S1 for easy operation by the operator. Furthermore, the front cover portion 12 is pivotally supported so as to be openable in a front down direction with respect to the main unit 1.

The front cover portion 12 of the multifunction device S1 according to the present embodiment has a handle that allows the operator to directly open/close the front cover portion 12. Furthermore, the multifunction device S1 of the present embodiment includes an opening/closing interlocking mechanism 20 (see FIG. 3) that opens/closes the upper cover portion 11 following the opening/closing operation of the front cover portion 12 by the operator.

Figure 3:
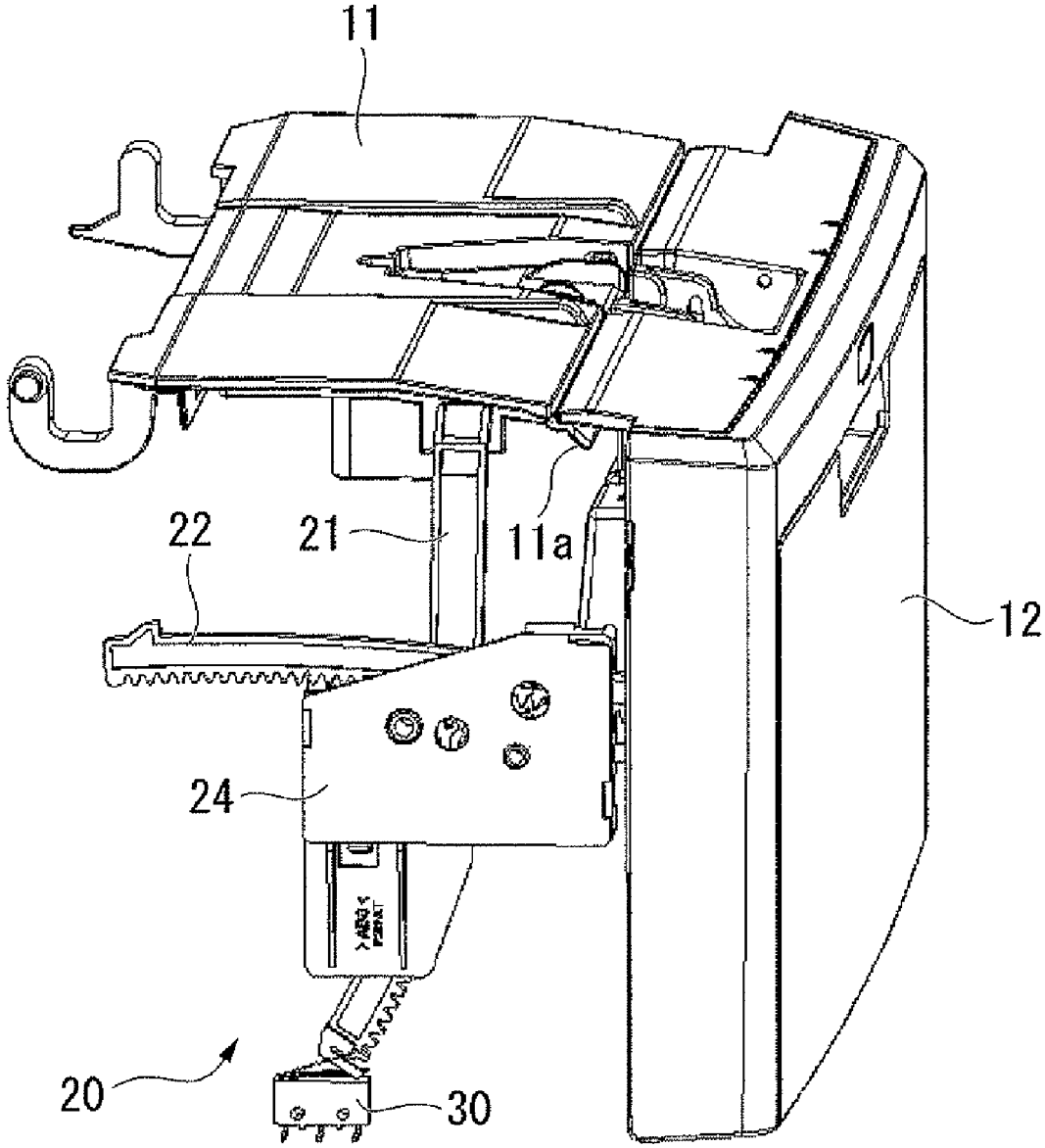
FIG. 3 is an exploded perspective view showing the upper cover portion, the front cover portion, and an opening/closing interlocking mechanism that are provided in the multifunction device according to the embodiment.
Figure 4:
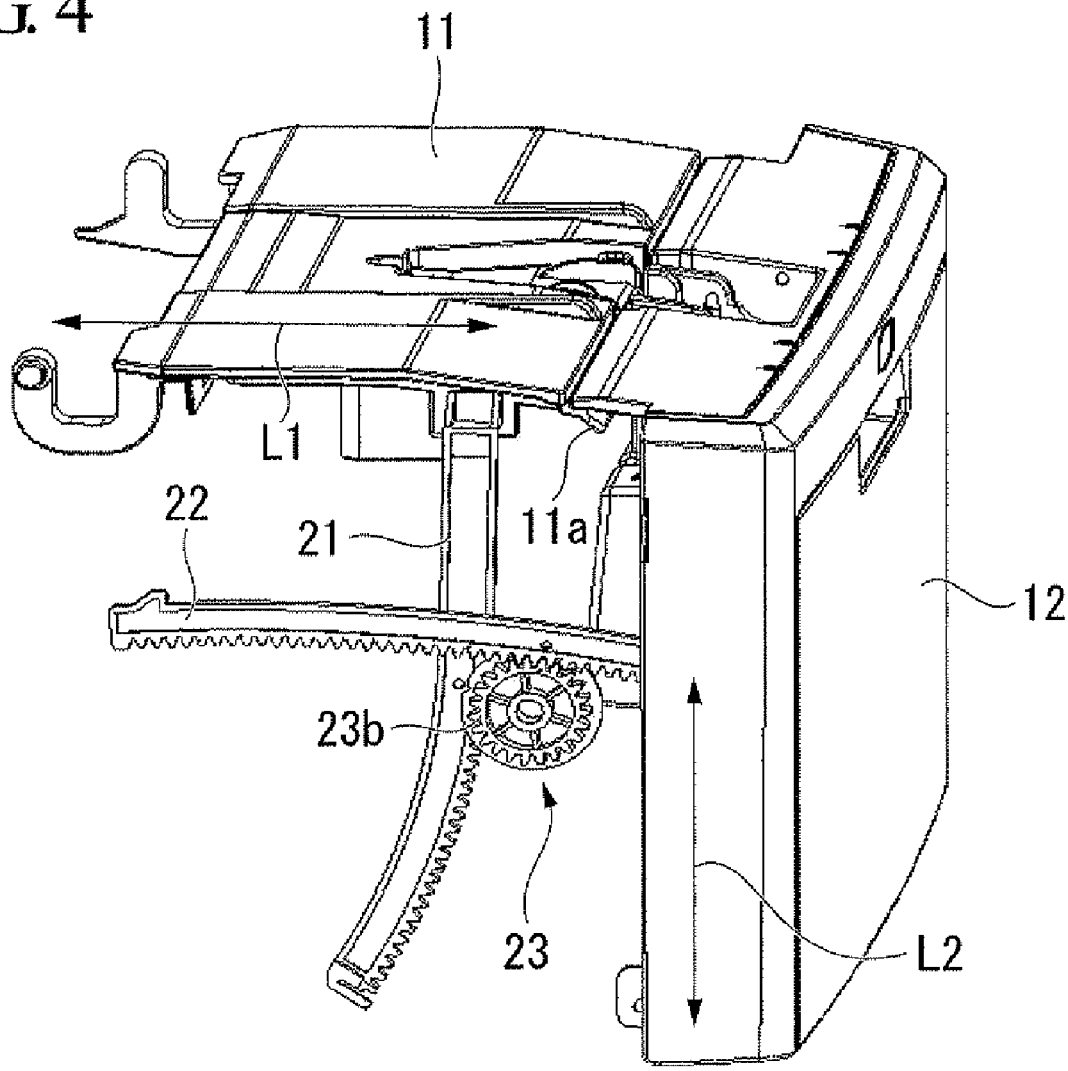
FIG. 4 is FIG. 3 with a holder omitted.
Figure 5:
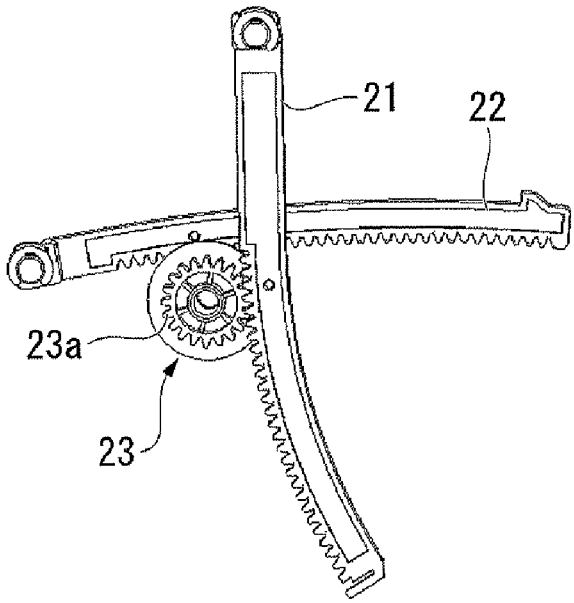
FIG. 5 shows a first rack, a second rack, and a pinion that are provided in the multifunction device according to the embodiment, as seen from a rear side.

FIG. 3 is an exploded perspective view showing the upper cover portion 11, the front cover portion 12, and the opening/closing interlocking mechanism 20. FIG. 4 shows FIG. 3 with a holder 24 omitted. FIG. 5 shows a first rack 21, a second rack 22, and a pinion 23 as seen from the opposite side of FIG. 4.

As shown in these figures, the opening/closing interlocking mechanism 20 includes: a first rack 21, a second rack 22, a pinion 23; and a holder 24.

The first rack 21 is connected to the upper cover portion 11. The second rack 22 is connected to the front cover portion 12. That is, in the multifunction device S1 of the present embodiment, a rack is provided on each of the plurality of cover portions.

The pinion 23 is arranged so as to be meshed with the first rack 21 and the second rack 22, as shown in FIG. 4 and FIG. 5. The pinion 23 includes: a first gear wheel 23*a* that is meshed with the first rack 21; and a second gear wheel 23*b* that is meshed with the second rack 22. The first gear wheel 23*a* and the second gear wheel 23*b* share the same rotation axis. With the rotation of either one of the first gear wheel 23*a* and the second gear wheel 23*b*, the other is rotated in the same direction. Furthermore, the first gear wheel 23*a* and the second gear wheel 23*b* are respectively engaged with the first rack 21 and the second rack 22 so that, when one of the racks is moved in a direction of opening one cover portion, the other rack is also moved in the direction of opening the other cover portion.

The holder 24 is fixed on the main unit 1, as shown in FIG. 3. The holder 24 movably supports the first rack 21 and the second rack 22, and rotatably supports the pinion 23.

The upper cover portion 11 and the front cover portion 12 are connected via the opening/closing interlocking mechanism 20 as described above. When the front cover portion 12 is opened by the operator, the second rack 22 connected to the front cover portion 12 is pulled downwardly to the front. As a result, the second gear wheel 23*b* of the pinion 23 that is meshed with the second rack 22 is rotated. With the rotation of the second gear wheel 23*b*, the first gear wheel 23*a* is rotated. With the rotation of the first gear wheel 23*a*, the first rack 21 moves in a direction of opening the upper cover portion 11 (in an upward direction). As a result, the upper cover portion 11 opens.

Figure 6:
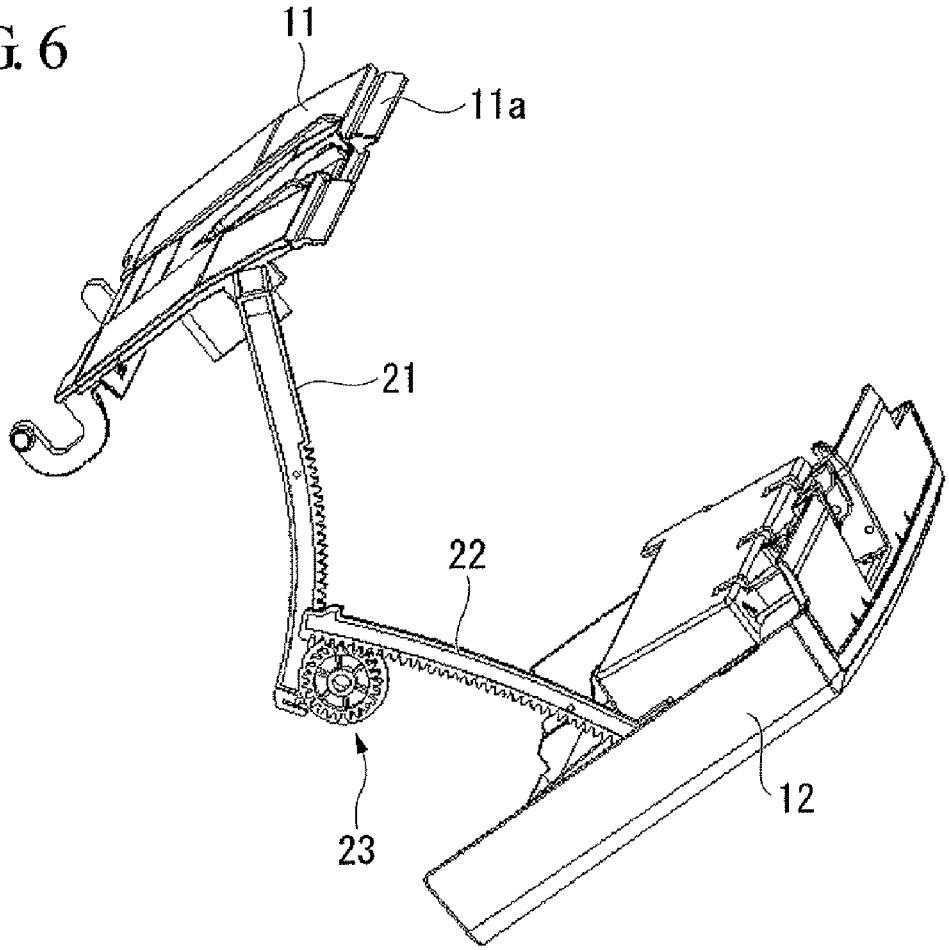
FIG. 6 is a diagram for explaining an operation of the opening/closing interlocking mechanism provided in the multifunction device according to the embodiment.

That is, according to the multifunction device S1 of the present embodiment, with the opening/closing operation of any one of the plurality of cover portions, the other cover portions are opened/closed in an interlocking manner, as shown in FIG. 6.

Furthermore, opening the upper cover portion 11 and the front cover portion 12 exposes the image creation unit 2. This makes it possible to take out the image creation unit 2 to the outside.

In the case where the connection position of the rack to the cover portion is relatively close to a pivot portion for opening/closing the cover portion, the amount of change in the opening/closing angle of the cover portion with respect to an amount of movement of the rack becomes large, thus causing the cover portion to open wide. In contrast, in the case where the connection position of the rack to the cover portion is relatively far from the pivot portion for opening/closing the cover portion, the amount of change in opening/closing angle of the cover portion with respect to the amount of movement of the rack becomes small, thus causing the cover portion to narrowly open.

Furthermore, in the case where the number of teeth of the gear wheel that are meshed with the rack is relatively large (in the case where the gear wheel has a large diameter), the amount of change in opening/closing angle of the cover portion with respect to an amount of rotation of the gear wheel becomes large, thus causing the cover portion to open wide. In contrast, in the case where the number of teeth of the gear wheel that are meshed with the rack is relatively small (in the case where the gear wheel has a small diameter), the amount of change in opening/closing angle of the cover portion with respect to the amount of rotation of the gear wheel becomes small, thus causing the cover portion to narrowly open.

That is, in the case where the opening/closing angle of the cover portion is made large to open the cover portion wide, the connection position of the rack may be brought close to the pivot portion for opening/closing the cover portion, or the number of teeth that are meshed with the rack may be made large. In contrast, in the case where the opening/closing angle of the cover portion is made small to narrowly open the cover portion, the connection position of the rack may be spaced away from the pivot portion for opening/closing the cover portion, or the number of teeth that are meshed with the rack may be decreased.

Here, in the multifunction device S1 of the present embodiment, the scanner portion 3 is arranged above the upper cover portion 11 as an obstacle to the opening/closing operation of the upper cover portion 11, as described above. Therefore, it is preferable that the opening/closing angle of the upper cover portion 11 be small. On the other hand, no obstacle is present around the front cover portion 12. Therefore, it is possible to secure a large opening/closing angle of the front cover portion 12.

As a result, in the multifunction device S1 of the present embodiment, the opening/closing angle of the upper cover portion 11 is set small so as to prevent interference with the scanner portion 3, and the opening/closing angle of the front cover portion 12 is set large so as to form an opening from which the image creation unit 2 can be taken out. That is, in the multifunction device S1 of the present embodiment, the opening/closing angle of the upper cover portion 11, which is positioned below the obstacle, is set smaller than the opening/closing angle of the front cover portion 12.

To be more specific, as shown in FIG. 4, a distance L1 between the connection position of the first rack 21 to the upper cover portion 11 and the pivot portion for opening/closing the upper cover portion 11 is set longer than a distance L2 between the connection position of the second rack 22 to the front cover portion 12 and the pivot portion for opening/closing the front cover portion 12. Furthermore, as shown in FIG. 4 and FIG. 5, the number of teeth of the first gear wheel 23*a* that are meshed with the first rack 21 is set smaller than the number of teeth of the second gear wheel 23*b* that are meshed with the second rack 22.

That is, in the multifunction device S1 of the present embodiment, the two racks are different in distance between the connection position of the rack to the cover portion and the pivot for opening/closing the cover portion. In addition, the two racks are different also in the number of teeth of the pinion for the rack.

Specific values for the distance L1 between the connection position of the first rack 21 to the upper cover portion 11 and the pivot portion for opening/closing the upper cover portion 11, the distance L2 between the connection position of the second rack 22 to the front cover portion 12 and the pivot portion for opening/closing the front cover portion 12, the number of teeth of the first gear wheel 23*a*, and the number of teeth of the second gear wheel 23*b* are determined so as to secure the opening from which the image creation unit 2 can be taken out when the upper cover portion 11 and the front cover portion 12 are opened, in consideration of circumstances surrounding the upper cover portion 11 and the front cover portion 12, and circumstances inside the main unit 1 that allow installation of the opening/closing interlocking mechanism 20.

That is, it is possible to flexibly adapt the arrangement of the opening/closing interlocking mechanism 20 according to the configuration the multifunction device S1.

Furthermore, in the multifunction device S1 of the present embodiment, when the upper cover portion 11 and the front cover portion 12 are closed (in the time of closure), the front cover portion 12 covers a part of the upper cover portion 11.

To be more specific, the upper cover portion 11 includes an overlap portion 11*a* that protrudes toward the front cover portion 12. The overlap portion 11*a* goes into the main unit 1 side earlier than the front cover portion 12 in the process of closing the upper cover portion 11 and the front cover portion 12. The length of the overlap portion 11*a* is set so as to go into the underside of the front cover portion 12.

The multifunction device S1 of the present embodiment further includes a safety switch 30 that is pressed down by the first rack 21 when the upper cover portion 11 and the front cover portion 12 are completely closed as shown in FIG. 3, to thereby allow a drive of the multifunction device S1 (an image formation).

Note that the safety switch 30 is omitted in the figures other than FIG. 3.

In the multifunction device S1 of the present embodiment that is configured as above, when the operator opens the front cover portion 12 in a state where the upper cover portion 11 and the front cover portion 12 are closed, the upper cover portion 11 is opened in an interlocking manner with the movement of the front cover portion 12 caused by the opening/closing interlocking mechanism 20. At this time, the first rack 21 is spaced away from the safety switch 30, leading to a halt of the drive of the multifunction device S1. This secures the safety of the operator.

On the other hand, when the operator closes the front cover portion 12 in a state where the upper cover portion 11 and the front cover portion 12 are opened, the upper cover portion 11 is closed in an interlocking manner with the movement of the front cover portion 12 caused by the opening/closing interlocking mechanism 20. At this time, the first rack 21 presses down the safety switch 30. This allows the drive of the multifunction device S1.

In the state where the upper cover portion 11 and the front cover portion 12 are closed, the front cover portion 12 covers the overlap portion 11*a* of the upper cover portion 11. Therefore, it is possible to prevent only the upper cover portion 11 from being opened/closed.

According to such a multifunction device S1 of the present embodiment, the openable cover portion 10 has a plurality of cover portions 11, 12. As a result, it is possible to reduce the size of the space necessary for opening the cover portion. Furthermore, the multifunction device S1 of the present embodiment, the upper cover portion 11 is opened/closed by the opening/closing interlocking mechanism 20 following the opening/closing operation of the front cover portion 12. Therefore, the operator can open/close all the panels by opening/closing only one cover portion 12 of the plurality of cover portions 11, 12.

Therefore, according to the multifunction device S1 of the present embodiment, it is possible to reduce the size of the space for opening/closing the cover portion, and also to facilitate opening/closing of the cover portion.

While the present invention has been described in detail with reference to the drawings, specific configurations are not limited to the above embodiment. Various design modifications and the like can be made as long as they do not depart from the spirit or scope of the invention.

For example, in the above embodiment, a multifunction device has been described as one example of the image forming apparatus of the present invention.

However, the image forming apparatus of the present invention may be a printer, a facsimile, a photocopier, or the like.

Furthermore, in the above embodiment, the description has been made with reference to the case where the cover portion 10 has the upper cover portion 11 and the front cover portion 12.

However, the present invention is not limited to this. The cover portion 10 may have more than two cover portions (panels).

Furthermore, in the above embodiment, the description has been made with reference to the case where the image creation unit 2 is an internal mechanism for image formation.

However, the present invention is not limited to this. The internal mechanism for image formation may be any of the internal mechanisms provided in a known multifunction device.

While a preferred embodiment of the invention has been described and illustrated above, it should be understood that this is exemplary of the invention and is not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. An image forming apparatus comprising:

an exterior portion having a first panel and a second panel that are opened/closed when an internal mechanism for image formation is taken outside; and an opening/closing interlocking device that makes the second panel open/close in connection with an opening/closing operation of the first panel, wherein the opening/closing interlocking device comprises:

a first rack which is connected to the second panel;

a second rack which is connected to the first panel;

a first pinion which is provided on a main unit of the image forming apparatus and meshed with the first rack; and a second pinion which is provided on the main unit of the image forming apparatus and meshed with the second rack.

2. The image forming apparatus according to claim 1, wherein a distance between a connection position of the first rack to the first panel and a pivot portion for opening/closing the first panel is different from a distance between a connection position of the second rack to the second panel and a pivot portion for opening/closing the second panel.

3. The image forming apparatus according to claim 1, wherein the first pinion and the second pinion are formed coaxially, and have a different number of teeth from each other.

4. The image forming apparatus according to claim 1, further comprising a safety switch that is pressed down by either one of the first rack and the second rack to allow a drive of the image forming apparatus in a state where the first panel and the second panel are closed.

5. The image forming apparatus according to claim 1, wherein the first panel covers a part of the second panel in a state where the first panel and the second panel are closed.

6. The image forming apparatus according to claim 5, wherein the first panel is provided on a front of the image forming apparatus.

7. The image forming apparatus according to claim 5, wherein the first panel is openable in a front down direction, and the second panel is openable in an up-down direction.

8. An image forming apparatus comprising:

an exterior portion having a first panel and a second panel that are opened/closed when an internal mechanism for image formation is taken outside; and an opening/closing interlocking device that makes the second panel open/close in connection with an opening/closing operation of the first panel, wherein:

the second panel is a panel opened to a paper discharge space formed between a paper discharge tray portion and a scanner portion of the image forming apparatus; and an opening/closing angle of the second panel is smaller than an opening/closing angle of the first panel.

9. The image forming apparatus according to claim 8, wherein the second panel is a part of the paper discharge tray portion.

10. The image forming apparatus according to claim 8, wherein the first panel covers a part of the second panel in a state where the first panel and the second panel are closed.

11. The image forming apparatus according to claim 10, wherein the first panel is provided on a front of the image forming apparatus.

12. The image forming apparatus according to claim 10, wherein the first panel is openable in a front down direction, and the second panel is openable in an up-down direction.

* * * * *